US008551927B2

(12) United States Patent
Saccomando et al.

(10) Patent No.: US 8,551,927 B2
(45) Date of Patent: Oct. 8, 2013

(54) LUBRICATING COMPOSITION

(75) Inventors: Daniel J. Saccomando, Sheffield (GB); Stuart L. Bartley, Wickliffe, OH (US); Shubhamita Basu, Willoughby, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/698,311

(22) PCT Filed: May 23, 2011

(86) PCT No.: PCT/US2011/037503

§ 371 (c)(1), (2), (4) Date: Mar. 19, 2013

(87) PCT Pub. No.: WO2011/149810

PCT Pub. Date: Dec. 1, 2011

(65) Prior Publication Data

US 2013/0210689 A1 Aug. 15, 2013

Related U.S. Application Data

(60) Provisional application No. 61/347,506, filed on May 24, 2010.

(51) Int. Cl.

| | |
|---|---|
| ***C10M 163/00*** | (2006.01) |
| ***C10M 133/16*** | (2006.01) |
| ***C10M 133/40*** | (2006.01) |

(52) U.S. Cl.

USPC ..... 508/554; 508/187; 508/192; 508/255; 508/259; 508/273; 508/436; 508/569

(58) Field of Classification Search

USPC ..... 508/186, 476, 500, 554

See application file for complete search history.

(56) References Cited

U.S. PATENT DOCUMENTS

| | | | |
|---|---|---|---|
| 2,892,854 | A | 6/1959 | Hommer |
| 3,214,377 | A | 10/1965 | Hotten |
| 3,284,409 | A | 11/1966 | Dorer et al. |
| 3,329,611 | A | 7/1967 | Chao |
| 3,436,348 | A | 4/1969 | Chao et al. |
| 3,825,495 | A | 7/1974 | Newingham et al. |
| 4,180,466 | A | 12/1979 | Newingham et al. |
| 4,242,101 | A | 12/1980 | Vogel et al. |
| 4,249,912 | A | 2/1981 | Holtz et al. |
| 4,308,154 | A | 12/1981 | Clason et al. |
| 5,487,838 | A | 1/1996 | Luciani et al. |
| 5,547,596 | A | 8/1996 | Omiya et al. |
| 2002/0119895 | A1 | 8/2002 | Cook et al. |
| 2008/0146474 | A1 | 6/2008 | Takahashi et al. |

FOREIGN PATENT DOCUMENTS

| | | |
|---|---|---|
| EP | 0399764 | 11/1990 |
| WO | 96/37585 | 11/1996 |

OTHER PUBLICATIONS

T.G. Davis et al., "Synergistic Antioxidants for Synthetic Lubricants", Industrial & Engineering Chemistry Product Research and Development, vol. 5, No. 1, pp. 76-80, Mar. 1, 1996.

Corresponding International Publication No. WO 2011/149810 A1 published Dec. 1, 2011.

Written Opinion from corresponding International Application No. PCT/US2011/037503 dated Aug. 18, 2011.

Search Report from corresponding International Application No. PCT/US2011/037503 dated Aug. 18, 2011.

*Primary Examiner* — Ellen Mcavoy
*Assistant Examiner* — Vishal Vasisth
(74) *Attorney, Agent, or Firm* — Michael F. Esposito; David M. Shold

(57) ABSTRACT

The invention relates to a lubricating composition containing (a) an oil of lubricating viscosity, and (b) an oil soluble compound with a >N—R—N< group, wherein R may be a hydrocarbylene group. The invention further provides for the use of the lubricating composition for lubricating a limited slip differential.

12 Claims, No Drawings

LUBRICATING COMPOSITION

This application is a 371 of PCT/US11/37503, filed May 23, 2011 which claims benefit of 61/347,506, filed May 24, 2010.

FIELD OF INVENTION

The invention relates to a lubricating composition containing (a) an oil of lubricating viscosity, and (b) an oil soluble compound with a >N—R—N<group having attached thereto three carboxyalkyl groups, wherein R may be a hydrocarbylene group. The invention further provides for the use of the lubricating composition for lubricating a limited slip differential.

BACKGROUND OF THE INVENTION

A limited slip differential in a vehicle typically employs a wet multi-plate clutch, i.e., clutch plates which are in contact with in a lubricant. The limited slip differential typically has bevel gear or spur gear planetary systems which distribute the drive torque evenly to the two driving wheels irrespective of their rotational speed. This makes it possible for the driven wheels to roll during cornering without slip between the wheel and road surface in spite of their different rotational speed. In order for the slip to be controlled lubricants containing compounds capable of improving friction performance, dispersants and sulphur- and/or phosphorus-containing extreme pressure agents may be used. Examples of lubricants of this type are disclosed in U.S. Pat. Nos. 4,308,154; 5,547,586; 4,180,466; 3,825,495; and European Patent Application 0 399 764 A1.

Lubricants containing compounds suitable for (i) deposit control (U.S. Pat. No. 3,284,409), and (ii) wear performance are described in International Application WO 96/037585, US Patent Application 2002/0119895, and U.S. Pat. No. 5,487,838.

SUMMARY OF THE INVENTION

An objective of the present invention is to provide a lubricating composition and method as disclosed herein that is capable of providing appropriate performance in at least one of (i) lubricant thermal stability, (ii) lubricant oxidative stability, (iii) high static coefficient of friction, (iv) fuel economy, (v) deposit control, (vi) seal compatibility, (vii) cleanliness and (viii) low tendency towards noise, vibration and harshness (NVH) often manifested as chatter (i.e. an abnormal noise typically referred to as a low-frequency "growl" and "groan", particularly during high-speed or low speed cornering maneuvers).

The lubricant composition and method disclosed herein may also be suitable for limited slip systems having one or more distinct plate materials. For example the plate materials may be steel, paper, ceramic, carbon fibres and systems employing a mixture of plate types such as steel on ceramic, carbon fibers in paper or steel on paper.

In one embodiment, the invention provides a lubricating composition comprising an oil of lubricating viscosity and an oil-soluble compound obtained or obtainable by a process of reacting an N-(2-hydroxyalk(en)yl)alkylenediamine-N,N',N'-tricarboxylic acid or an N-(alk(en)yl)alkylenediamine-N,N',N'-tricarboxylic acid or an alkylenediamine-N,N,N',N'-tetracarboxylic acid with an amine or an alcohol.

In one embodiment or, in an alternative expression, the invention provides lubricating composition comprising an oil of lubricating viscosity and an oil-soluble compound represented by formula (1)

formula (1)

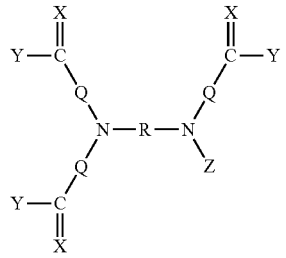

wherein:

R is an aliphatic hydrocarbylene group of 1 to about 20 (or 1 to 10, or 1 to 5 or 2 to 3, or 2) carbon atoms;

Each Q is independently an aliphatic hydrocarbylene group of 1 to about 10 (or 1 to 5, or 1 to 4, or 1 to 3, or 1) carbon atoms;

Each X is independently O or $NR^1$;

Each Y is independently $NR^2R^3$ or $OR^4$ or a group as further defined below;

Z is an aliphatic hydrocarbyl group substituted with an —OH group; or an aliphatic hydrocarbyl group; or a -Q-C(═X)—Y group;

wherein:

each $R^1$ is independently hydrogen or a hydrocarbyl group; or $R^1$ and $R^2$ on an adjacent N atom may together form a cyclic imidazoline structure (adjacent N atoms are N atoms as a part of X and Y, being bonded to the same carbon atom in formula (1));

each $R^2$ is independently a hydrocarbyl group or an amino-substituted hydrocarbyl group or an ether-substituted hydrocarbyl group or a hydroxy-substituted hydrocarbyl group; or $R^2$ and $R^1$ on an adjacent N atom may together form a cyclic imidazoline structure;

each $R^3$ is independently H or a hydrocarbyl group;

each $R^4$ is independently a hydrocarbyl group;

wherein further:

two such Y groups may be joined together to form a cyclic imide structure, and one such Y group and an —OH group within the Z group may be joined together to form a lactone structure;

and wherein further:

each Y may independently represent

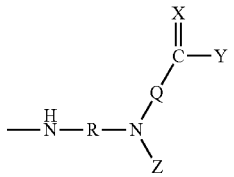

whereby the compound may represent a dendritic structure being terminated with groups in which Y is $—NR^2R^3$ or $—OR^4$; or with $—NH—R—NH_2$ groups.

In one embodiment, the invention provides a method of lubricating a limited slip differential comprising supplying to the limited slip differential a lubricating composition as disclosed herein.

In one embodiment, the invention provides for the use of a lubricating composition disclosed herein in a limited slip differential to provide an acceptable level of at least one of (i) lubricant thermal stability, (ii) lubricant oxidative stability, (iii) friction coefficient, (iv) fuel economy, (v) deposit control, (vi) seal compatibility, and (vii) chattering (abnormal noise). In one embodiment the use provides an acceptable level of friction coefficient.

DETAILED DESCRIPTION OF THE INVENTION

The present invention provides a lubricating composition and method as disclosed herein above.

As used herein the expression "oil-soluble" or "hydrocarbon soluble" is meant a material which will dissolve or disperse on a macroscopic or gross scale in an oil or hydrocarbon, as the case may be, typically a mineral oil, such that a practical solution or dispersion can be prepared. In order to prepare a useful lubricant formulation, the compound of formula (1) should not precipitate or settle out over a course of several days or weeks. Such materials may exhibit true solubility on a molecular scale or may exist in the form of agglomerations of varying size or scale, provided however that they have dissolved or dispersed on a gross scale.

The oil-soluble compound of the present invention may be prepared from the reaction of an N-(2-hydroxyalk(en)yl) alkylenediamine-N,N',N'-tricarboxylic acid or an N-(alk(en) yl)alkylenediamine-N,N',N'-tricarboxylic acid or an alkylenediamine-N,N,N',N'-tetracarboxylic acid. The expressions "alkylenediamine-N,N',N'-tricarboxylic acid" or "alkylendiamine-N,N,N',N'-tetracarboxylic acid" are intended to encompass the corresponding alkyl or alkylene tricarboxylic or tetracarboxylic acids, such as tri- or tetramethylenecarboxylic acid or tri- or tetra-ethylenecarboxylic acid. Such materials are commonly named with reference to the corresponding alkanoic acid, such as the tri- or tetraacetic acid. Typical examples of such materials include N-(2-hydroxyethyl)ethylenediamine-N,N',N'-triacetic acid, N-(ethyl)ethylenediamine-N,N',N'-triacetic acid, and ethylenediamine-N,N,N',N'-tetraacetic acid, which is also commonly referred to as "EDTA." EDTA may be more systematically named as {[2-(bis-carboxymethyl-amino)-ethyl] carboxymethyl-amino}-acetic acid. The corresponding hydroxyethyl triacid may be more systematically named as (carboxymethyl-{2-[carboxymethyl-(2-hydroxy-ethyl)-amino]-ethyl}amino)-acetic acid.

These materials are commercially available. Ethylenediamine-tetraacetic acid, for example, is commercially prepared from ethyenediamine, formaldehyde and sodium cyanide. Addition of higher acids to ethylenediamine may be effected by a Michael addition of an unsaturated carboxylic acid such as acrylic or methacrylic acids or esters thereof or mixtures thereof.

The addition product, that is, the alkylenediamine tri- or tetracarboxylic acid, may be reacted with an amine to form the oil-soluble compound of the present invention. This reaction may be carried out at elevated temperatures such as greater than 40° C. to 180° C. The amine may be a primary amine or a secondary amine. It may be described as a hydrocarbyl amine or a dihydrocarbylamine the hydrocarbyl group or groups thereof having about 12 to about 22 carbon atoms as described herein below. Alternatively, an alcohol may be used in place of some or all of the amine.

If an amine is reacted, the amine may alternatively contain one or more groups represented by the structure -Q-C(═X)—Y, wherein each of Q, X and Y are defined below. Typically the group Q may be an alkylene group containing 1 to 4 carbon atoms or a group comprising a chain of 2 to 9 carbon atoms interrupted by one or two nitrogen or oxygen atoms within the chain. The amine may include two groups of the structure -Q-C(═X)—Y on an amine nitrogen atom. In one embodiment the amine includes multiple amine nitrogen atoms, at least two of which bear a group of the structure -Q-C(═X)—Y.

The hydrocarbyl amine may be a polyamine in the "Duomeen" series, available from Akzo Nobel. A more detailed description of Duomeen chemistry is provided in International Patent Application PCT/US10/023,867 (claims priority from U.S. Patent application No. 61/153,396) paragraphs [0029] to [0032].

In one embodiment, the oil-soluble compound described herein may be a material represented by formula (1)

formula (1)

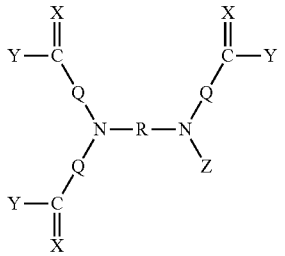

In this structure, the N—R—N central portion may correspond to an alkylenediamine as described above, such as ethylenediamine. R is thus an aliphatic hydrocarbylene group of 1 to 20 carbon atoms, or alternatively 1 to 10, or 1 to 5 or 2 to 3, or 2 carbon atoms.

The central N—R—N portion of formula (1) is linked to multiple —C(═X)Y groups by means of Q groups or linkages. Each Q is independently an aliphatic hydrocarbylene group of 1 to 10 carbon atoms, or 1 to 5, or 1 to 4, or 1 to 3, or 1 carbon atom. In other embodiments, each Q is independently a $—(CR^5{}_2)_w—$group, where each $R^5$ is independently hydrogen or a $C_{1-4}$ alkyl group and where each w is independently 1 to 3 (or 2) In one embodiment, Q is a methylene group; in another embodiment, an ethylene group.

Each Q group, in turn is typically linked to a group represented by —C(═X)Y. This may represent an ester group, an amide, groups or related oxygen- and/or nitrogen-containing groups. That is, each X may independently by O or $NR^1$, wherein each $R^1$ is independently hydrogen or a hydrocarbyl group; or $R^1$ and $R^2$ on an adjacent N atom may together form a cyclic imidazoline structure. Each Y may independently be $NR^2R^3$ or $OR^4$ or a group as further defined below. Each $R^2$ may independently be a hydrocarbyl group or an amino-substituted hydrocarbyl group or an ether-substituted hydrocarbyl group or a hydroxy-substituted hydrocarbyl group; or $R^2$ and $R^1$ on an adjacent N atom may together form a cyclic imidazoline structure; Each $R^3$ may independently be H or a hydrocarbyl group; each $R^4$ may independently be a hydrocarbyl group.

The formation of a cyclic imidazoline structure is a well-known chemical phenomenon, which often readily occurs when an alkylene diamine is condensed with a carboxylic acid. After an initial condensation to form an amide, subsequent cyclisation may occur to form an imidazoline.

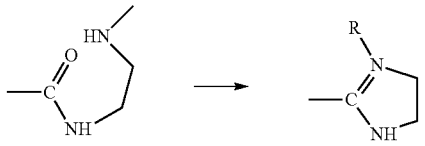

This is what is meant by the expression that $R^1$ and $R^2$ on an adjacent nitrogen atom together to form an imidazoline structure. The adjacent nitrogen atoms are those that participate in the cyclisation process and are those shown in the structure above.

A related form of cyclisation may also occur between -Q-C(═X)Y groups, in particular those groups which are bonded to the same nitrogen atom. That is, two such groups may be cyclised to form an imide such as

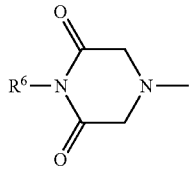

In such an imide $R^6$ may be a hydrocarbyl group having 1 to 100, or 1 to 50, or 4 to 20, or 6 to 8 carbon atoms. Similar cyclisations may occur involving the Z group, as described below.

In the structure of formula 1, the Z group may be an aliphatic hydrocarbyl group substituted with an —OH group, often in the 2 position (e.g., a hydroxyethyl group); or an aliphatic hydrocarbyl group; or a -Q-C(═X)—Y group as defined above.

When the Z group is an aliphatic hydrocarbyl group substituted with an —OH group in, for instance, the 2-position, it may undergo cyclisation with a carboxyl group, such as that bonded to the same nitrogen through a Q group, to form a lactone

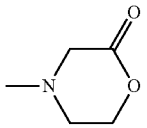

Lactones of 5 or 6 membered rings are readily formed. Typically the compound of formula (1) does not contain both an imidazoline group and a lactone group.

It is also possible that one or more of the Y groups in formula 1 may independently represent the structure

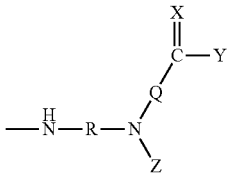

It will be evident that compounds with such structures may have an additional Y group within an original Y group, leading to a repeating structure. Such materials are referred to as dendrimers, or as having a dendritic structure. Ultimately, each branch will be terminated with a group in which Y is —$NR^2R^3$ or with —NH—R—$NH_2$ groups.

The dendrimer of the present invention may be described in more detail in WO 2007039457 A1 (page 5, line 7 to page 8, line 10) or in WO 2000034418 (page 1, line 25 to page 2, line 9, and page 5, line 1 to page 8, line 21). The dendrimer may be in the form of a salt or an acid, or mixtures thereof.

The dendrimer may for instance include a compound with CAS Registry numbers 142986-44-5 (commercially sold as PAMAM dendrimer (G-1)), or 155773-72-1 (may also be referred to as 3,3',3",3'"-(1,2-ethanediyldinitrilo)tetrakis[N-(2-aminoethyl)-propanamide).

If the dendrimer is in the form of a salt, the salt may be a metal or ammonium salt. The metal of the metal salt may be sodium, potassium, lithium, calcium or magnesium (typically sodium). When the dendrimer is a salt, the compound of formula (1) may be derived such that the compound has CAS Registry number 202009-64-1 (commercially available as Starburst Generation™ 1.5).

When the compound of formula (1) has one or more imidazoline groups, the amine may typically include a hydrocarbyl amine, the hydrocarbyl group thereof having about 12 to about 22 carbon atoms as described previously. For example the hydrocarbyl amine may be reacted with N-(2-hydroxyalk(en)yl)alkylenediamine-N,N',N'-tricarboxylic acid at 120° C. to 150° C. resulting in a mixture of compounds defined within formula (1). The compound of formula (1) may have a mixture of imidazoline and amide groups. Upon heating to above about 150° C. (for some imidazolines (that may have hindered groups surrounding nitrogen atoms) the reaction temperature may be up to 250° C.,) the compound of formula (1) may have two imidazoline groups.

The oil soluble compound of the present invention may be prepared at atmospheric pressure or elevated pressure, typically atmospheric pressure. The reaction atmosphere may be air or inert (such as nitrogen, or argon), typically in air. The solvent may include an aliphatic or an aromatic solvent. The solvent may for instance be diluent oil, xylene, toluene, or mixtures thereof. Typically the reaction does not require a catalyst.

The compound of formula (1) may be formed as a single component or as part of a mixture. If the compound of formula (1) is part of a mixture, a typical mixture may comprise (a) at least 50 mole % to 99.9 mole % (or at least 60 mole % to 90 mole %) of:

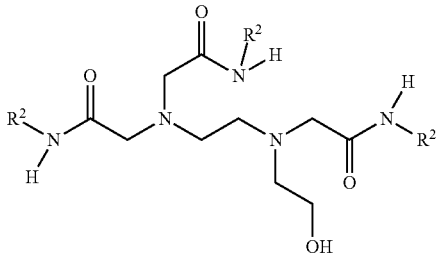

and (b) 0.1 mole % to less than 50 mole % (0.1 mole % to or less than 40 mole %) of

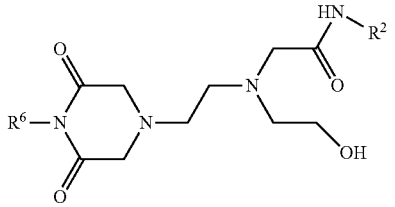

wherein $R^2$ is a hydrocarbyl group (typically containing 1 to 150, or 1 to 50, or 4 to 30 carbon atoms), or an amino-substituted hydrocarbyl group (such as $—(CH_2)_m—NH_2$, or $—(CH_2)_gCH(NH_2)—(CH_2)_fCH_3$), or an ether-substituted hydrocarbyl group (such as $—(CH_2)_gO—(CH_2)_fCH_3$), or a hydroxy-substituted hydrocarbyl group (such as $—(CH_2)_m—OH$, or $—(CH_2)_gCH(OH)—(CH_2)_fCH_3$); wherein m is 1 to 150, 1 to 50, or 4 to 30 and the total sum of f and g is 0 to 149, or 0 to 150, or 3 to 29, or 13 to 19; and $R^6$ is a hydrocarbyl group having 1 to 100, or 1 to 50, or 4 to 20, or 6 to 18 carbon atoms.

The compound of formula (1) may be present in the lubricating composition in an amount in the range of 0.01 wt % to 5 wt %, or 0.1 wt % to 3 wt %, or 0.2 wt % to 2 wt % of the lubricating composition.

Amine Salt of a Phosphoric Acid Ester

In one embodiment the lubricating composition further includes an amine salt of a phosphoric acid ester. The phosphoric acid utilised to prepare the phosphoric acid ester amine salt may be either a phosphoric acid or a thiophosphoric acid.

The amine salt of a phosphoric acid ester may contain ester groups each having 1 to 30, 6 to 30, 8 to 30, 10 to 24 or 12 to 20, or 16 to 20 carbon atoms, with the proviso that a portion or all of ester groups are sufficiently long to solubilise the amine salt of a phosphoric acid ester in an oil of lubricating viscosity. Typically ester groups containing 4 or more carbon atoms are particularly useful.

Examples of suitable ester groups include isopropyl, methyl-amyl (may also be referred to as 1,3-dimethyl butyl), 2-ethylhexyl, heptyl, octyl, nonyl, decyl, dodecyl, butadecyl, pentadecyl, hexadecyl, heptadecyl, octadecyl, nonadecyl, eicosyl, or mixtures thereof.

In one embodiment the ester groups is selected from the group consisting of isopropyl, methyl-amyl (may also be referred to as 1,3-dimethyl butyl), 2-ethylhexyl, heptyl, octyl, nonyl, decyl, and mixtures thereof.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as linear amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, ethylamylamine, dicocoamine and di-2-ethylhexylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

The amine salt of a phosphorus acid ester may be a reaction product of a $C_{12-20}$ alkyl phosphoric acid with a tertiary $C_{11-22}$ alkyl primary amine.

In one embodiment the amine salt of a phosphorus acid ester includes an amine with C11 to C14 tertiary alkyl primary amino groups or mixtures thereof. In one embodiment the amine salt of a phosphorus compound includes an amine with C14 to C18 tertiary alkyl primary amines or mixtures thereof. In one embodiment the amine salt of a phosphorus compound includes an amine with C18 to C22 tertiary alkyl primary amines or mixtures thereof.

In one embodiment the amine salt of a phosphorus acid ester includes the reaction product of octadecenyl phosphoric acid with Primene 81R™.

Mixtures of amines may also be used in the invention. In one embodiment a useful mixture of amines is "Primene™ 81R" and "Primene™ JMT." Primene™ 81R and Primene™ JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid ester is the reaction product of a C14 to C18 alkylated phosphoric acid with Primene 81 R™ which is a mixture of C11 to C14 tertiary alkyl primary amines.

Examples of the amine salt of a phosphorus acid ester include the reaction product(s) of isopropyl, methyl-amyl (1,3-dimethyl butyl or mixtures thereof), 2-ethylhexyl, heptyl, octyl, nonyl or decyl dithiophosphoric acids with ethylene diamine, morpholine, or Primene 81R™, and mixtures thereof.

Examples of the amine salt of a phosphorus acid ester include the reaction product(s) of tetradecyl, pentadecyl, hexadecyl, heptadecyl, octadecyl, nonadecyl or eicosyl dithiophosphoric acids with ethylene diamine, morpholine, or Primene 81R™, and mixtures thereof. In one embodiment the amine salt of a phosphorus acid ester includes the reaction product of octadecenyl dithiophosphoric acid with Primene 81R™.

In one embodiment the amine salt of a phosphorus compound may be an amine salt of either (i) a hydroxy-substituted di-ester of phosphoric acid, or (ii) a phosphorylated hydroxy-substituted di- or tri-ester of phosphoric acid. A more detailed description of this type of compound is described in International Publication WO 2008/094759.

In one embodiment the amine salt of a phosphoric acid is a compound described in U.S. Pat. No. 3,197,405. In one embodiment the amine salt of a phosphorus compound other than those disclosed above, may be prepared by any one of examples 1 to 25 of U.S. Pat. No. 3,197,405.

In one embodiment the amine salt of a phosphorus compound other than those disclosed above, is a reaction product prepared from a dithiophosphoric acid or phosphoric acid with an epoxide or a glycol. This reaction product is further reacted with a phosphorus acid, anhydride, or lower ester (where "lower" signifies 1 to 8, or 1 to 6, or 1 to 4, or 1 to 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols include aliphatic glycols having 2 to 12, or 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids are then salted with amines.

An example of suitable dithiophosphoric acid based product is prepared by adding phosphorus pentoxide (about 64 grams) at 58° C. over a period of 45 minutes to 514 grams of hydroxypropyl O,O-di(1,3-dimethylbutyl)-phosphorodithioate (prepared by reacting di(1,3-dimethylbutyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue). This acid may then be salted with an amine such as Primene™ 81R.

The amine salt of a phosphorus acid ester may be present at 0 wt % to 5 wt %, or 0.01 wt % to 5 wt %, or 0.01 wt % to 2 wt %, or 0.25 wt % to 1 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition of the invention optionally further includes at least one other performance additive. The other performance additives include dispersants, metal deactivators, detergents, viscosity modifiers, extreme pressure agents (typically boron- and/or sulphur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents, friction modifiers and mixtures thereof.

The total combined amount of the other performance additives (excluding the viscosity modifiers) present on an oil free basis may include ranges of 0 wt % to 25 wt %, or 0.01 wt % to 20 wt %, or 0.1 wt % to 15 wt % or 0.5 wt % to 10 wt %, or 1 to 5 wt % of the composition. Although one or more of the other performance additives may be present, it is common for the other performance additives to be present in different amounts relative to each other.

In one embodiment the lubricating composition is free of molybdenum-containing additives.

Viscosity Modifiers

In one embodiment the lubricating composition further includes one or more viscosity modifiers. When present the viscosity modifier may be present in an amount of 0.5 wt % to 70 wt %, 1 wt % to 60 wt %, or 5 wt % to 50 wt %, or 10 wt % to 50 wt % of the lubricating composition.

Viscosity modifiers include (a) polymethacrylates, (b) esterified copolymers of (i) a vinyl aromatic monomer and (ii) an unsaturated carboxylic acid, anhydride, or derivatives thereof, (c) esterified interpolymers of (i) an alpha-olefin; and (ii) an unsaturated carboxylic acid, anhydride, or derivatives thereof, or (d) hydrogenated copolymers of styrene-butadiene, (e) ethylene-propylene copolymers, (f) polyisobutenes, (g) hydrogenated styrene-isoprene polymers, (h) hydrogenated isoprene polymers, or (i) mixtures thereof.

In one embodiment the viscosity modifier includes (a) a polymethacrylate, (b) an esterified copolymer of (i) a vinyl aromatic monomer; and (ii) an unsaturated carboxylic acid, anhydride, or derivatives thereof, (c) an esterified interpolymer of (i) an alpha-olefin; and (ii) an unsaturated carboxylic acid, anhydride, or derivatives thereof, or (d) mixtures thereof.

Extreme Pressure Agents

Extreme pressure agents include compounds containing boron and/or sulphur and/or phosphorus. The extreme pressure agent may be present in the lubricating composition at 0 wt % to 20 wt %, or 0.05 wt % to 10 wt %, or 0.1 wt % to 8 wt % of the lubricating composition.

In one embodiment the extreme pressure agent is a sulphur-containing compound. In one embodiment the sulphur-containing compound may be a sulphurised olefin, a polysulphide, or mixtures thereof.

Examples of the sulphurised olefin include a sulphurised olefin derived from propylene, isobutylene, pentene; an organic sulphide and/or polysulphide including benzyldisulphide; bis-(chlorobenzyl) disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment the sulphurised olefin includes a sulphurised olefin derived from propylene, isobutylene, pentene or mixtures thereof.

In one embodiment the extreme pressure agent sulphur-containing compound includes a dimercaptothiadiazole or derivative, or mixtures thereof. Examples of the dimercaptothiadiazole include 2,5-dimercapto-1,3,4-thiadiazole or a hydrocarbyl-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form derivatives or oligomers of two or more of said thiadiazole units. Suitable 2,5-dimercapto-1,3,4-thiadiazole derived compounds include 2,5-bis(tert-nonyldithio)-1,3,4-thiadiazole or 2-tert-nonyldithio-5-mercapto-1,3,4-thiadiazole.

The number of carbon atoms on the hydrocarbyl substituents of the hydrocarbyl-substituted 2,5-dimercapto-1,3,4-thiadiazole typically include 1 to 30, or 2 to 20, or 3 to 16.

In one embodiment the extreme pressure agent includes a boron-containing compound. The boron-containing compound includes a borate ester (which in some embodiments may also be referred to as a borated epoxide), a borated alcohol, a borated dispersant or mixtures thereof. In one embodiment the boron-containing compound may be a borate ester or a borated alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms i.e. vicinal.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment suitable borate ester compounds include tripropyl borate, tributyl borate, tripentyl borate, trihexyl borate, triheptyl borate, trioctyl borate, trinonyl borate and tridecyl borate. In one embodiment the borate ester compounds include tributyl borate, tri-2-ethylhexyl borate or mixtures thereof.

In one embodiment, the boron-containing compound is a borated dispersant, typically derived from an N-substituted long chain alkenyl succinimide. In one embodiment the borated dispersant includes a polyisobutylene succinimide. Borated dispersants are described in more detail in U.S. Pat. No. 3,087,936; and U.S. Pat. No. 3,254,025.

In one embodiment the borated dispersant may be used in combination with a sulphur-containing compound or a borate ester.

In one embodiment the extreme pressure agent is other than a borated dispersant.

The number average molecular weight of the hydrocarbon from which the long chain alkenyl group was derived includes ranges of 350 to 5000, or 500 to 3000, or 550 to 1500. The long chain alkenyl group may have a number average molecular weight of 550, or 750, or 950 to 1000.

The N-substituted long chain alkenyl succinimides are borated using a variety of agents including boric acid (for example, metaboric acid, $HBO_2$, orthoboric acid, $H_3BO_3$, and tetraboric acid, $H_2B_4O_7$), boric oxide, boron trioxide, and alkyl borates. In one embodiment the borating agent is boric acid which may be used alone or in combination with other borating agents.

The borated dispersant may be prepared by blending the boron compound and the N-substituted long chain alkenyl succinimides and heating them at a suitable temperature, such as, 80° C. to 250° C., or 90° C. to 230° C., or 100° C. to 210° C., until the desired reaction has occurred. The molar ratio of the boron compounds to the N-substituted long chain alkenyl succinimides may have ranges including 10:1 to 1:4, or 4:1 to 1:3; or the molar ratio of the boron compounds to the N-substituted long chain alkenyl succinimides may be 1:2. An inert liquid may be used in performing the reaction. The liquid may include toluene, xylene, chlorobenzene, dimethylformamide or mixtures thereof.

Friction modifiers (other than (a) a borated phospholipid, and (b) an amine salt of a phosphoric acid ester) include fatty amines, esters such as borated glycerol esters, fatty phosphites, fatty phosphonate esters, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines, and reaction products from fatty carboxylic acids reacted with guanidine, aminoguanidine, urea, thiourea, and salts thereof.

In one embodiment the lubricating composition may contain phosphorus- or sulphur-containing antiwear agents other than compounds described as an extreme pressure agent of the amine salt of a phosphoric acid ester described above. Examples of the antiwear agent may include a non-ionic phosphorus compound (typically compounds having phosphorus atoms with an oxidation state of +3 or +5), a metal dialkyldithiophosphate (typically zinc dialkyldithiophosphates), a metal mono- or di-alkylphosphate (typically zinc phosphates), or mixtures thereof.

The non-ionic phosphorus compound includes a phosphite ester, a phosphate ester, or mixtures thereof. A more detailed description of the non-ionic phosphorus compound include column 9, line 48 to column 11, line 8 of U.S. Pat. No. 6,103,673.

In one embodiment the lubricating composition of the invention further includes a dispersant. The dispersant may be a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant or a polyetheramine dispersant.

In one embodiment the succinimide dispersant includes a polyisobutylene-substituted succinimide, wherein the polyisobutylene from which the dispersant is derived may have a number average molecular weight of 400 to 5000, or 950 to 1600.

Succinimide dispersants and their methods of preparation are more fully described in U.S. Pat. Nos. 4,234,435 and 3,172,892.

Suitable ester-containing dispersants are typically high molecular weight esters. These materials are described in more detail in U.S. Pat. No. 3,381,022.

In one embodiment the dispersant includes a borated dispersant. Typically the borated dispersant includes a succinimide dispersant including a polyisobutylene succinimide, wherein the polyisobutylene from which the dispersant is derived may have a number average molecular weight of 400 to 5000. Borated dispersants are described in more detail above within the extreme pressure agent description.

In one embodiment the dispersant may be a post treated dispersant. The dispersant may be post treated with dimercaptothiadiazole, optionally in the presence of one or more of a phosphorus compound, a dicarboxylic acid of an aromatic compound, and a borating agent.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed for example in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof, (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed for example in International Application WO 2006/654726 A.

Examples of a suitable dimercaptothiadiazole include 2,5-dimercapto-1,3,4-thiadiazole or a hydrocarbyl-substituted 2,5-dimercapto-1,3-4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof.

Dispersant viscosity modifiers (often referred to as DVMs) include functionalised polyolefins, for example, ethylene-propylene copolymers that have been functionalized with the reaction product of maleic anhydride and an amine, a polymethacrylate functionalised with an amine, or esterified styrenemaleic anhydride copolymers reacted with an amine may also be used in the composition of the invention.

Corrosion inhibitors include 1-amino-2-propanol, octylamine octanoate, condensation products of dodecenyl succinic acid or anhydride and/or a fatty acid such as oleic acid with a polyamine.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Foam inhibitors include copolymers of ethyl acrylate and 2-ethylhexylacrylate and optionally vinyl acetate; or silicones or polysiloxanes.

Demulsifiers include trialkyl phosphates, and various polymers and copolymers of ethylene glycol, ethylene oxide, propylene oxide, or mixtures thereof.

Pour point depressants including esters of maleic anhydride-styrene, polymethacrylates, polyacrylates or polyacrylamides.

Seal swell agents including Exxon Necton-37™ (FN 1380) and Exxon Mineral Seal Oil™ (FN 3200).

INDUSTRIAL APPLICATION

The self-contained lubricant of the limited slip differential is generally different from the lubricant supplied to a manual transmission or an automatic transmission fluid. In both the manual and automatic transmission systems not comprising a limited slip differential, one lubricant is typically sufficient to lubricate all of the transmission constituents.

The lubricating composition is suitable for use with torque coupling devices which have isolated sumps from the axle.

An axle gear may have any one of a number of different types of differentials. A differential typically has three major functions. The first function is to transmit engine power to the wheels. The second function is act as the final gear reduction in the vehicle, slowing the rotational speed from the transmission to the wheels. The third function is to transmit the power to the wheels while allowing them to rotate at different speeds. A number of differentials are known and include an open differential, a clutch-type limited slip differential, a viscous coupling differential, a Torsen differential and a locking differential. All of these differentials may be generically referred to as axle gears.

Axle gears typically require a lubricant. The lubricant formulation is dependent on the type of axle gear, and the operating conditions of the axle gear. For example, an open differential axle gear is believed to require antiwear and/or extreme pressure additives. In contrast, a limited slip differential typically requires a friction modifier because, in addition to an open differential (known from many axle fluids), a spring pack and a clutch pack are typically present. The clutch pack may contain one or more reaction plates (often made from steel) and one or more friction plates. The friction plates are known, and may be made from a number of materials including paper, carbon, graphite, steel and a composite.

The lubricating composition suitable for the limited slip differential may have a sulphur content in the range of 0.3 wt % to 5 wt %, or 0.5 wt % to 5 wt %, or 0.5 wt % to 3 wt % or 0.8 wt % to 2.5 wt %, or 1 wt % to 2 wt %.

In one embodiment the lubricating composition suitable for the limited slip differential may be a fully formulated fluid.

In one embodiment the lubricating composition suitable for the limited slip differential may be a top treat concentrate.

When the lubricating composition is in the form of a top treat concentrate, the concentrate may be added at 0.2 wt % to 10 wt %, or 0.5 wt % to 7 wt % relative to the amount of lubricant in a limited slip differential.

The following examples provide illustrations of the invention. These examples are non exhaustive and are not intended to limit the scope of the invention.

EXAMPLES

Preparative Example 1 (EX1)

Toluene (450 ml) and N-(2-hydroxyethyl)ethylenediamine-N,N',N'-triacetic acid (HEDTA) (53.5 g) are combined with stirring under a $N_2$ atmosphere. To this mixture oleylamine (154.3 g) is added in one portion. The reaction is heated to 115° C. and stirred for 4 hours. The reaction is heated further by allowing the toluene to distil from the flask so that the temperature reached 140-145° C., water was drained from the Dean-Stark trap. The reaction is then heated at 155° C. for 5 hours. The reaction is then concentrated under reduced pressure using a rotary evaporator.

Preparative Example 2 (EX2)

To a 1 L 4-necked flask fitted with mechanical stirrer, Dean-Stark trap topped with condenser, thermowell, and nitrogen inlet is charged N-(2-hydroxyethyl)ethylenediamine-N,N',N'-triacetic acid (125 g), toluene (102 g), and oleyl amine (373 g, 3 equivalent). The temperature is raised to 115° C. and held for one hour. The flask is then heated to 130° C. and held for two hours. The flask is then heated to 140° C. and held for a further six hours. Toluene is removed by stripping at 140° C. over a period of three hours. The final product is a brown liquid. Yield=466 g.

Preparative Example 3 (EX3)

To a 2 L 4-necked flask equipped with a mechanical stirrer, thermocouple, Dean-Stark trap topped with a condenser, and a $N_2$ inlet is charged N-(2-hydroxyethyl)ethylenediamine-N,N',N'-triacetic acid (90 g) and xylene (490 g). The reaction is then heated to 135° C. for a period of one hour. Oleyl amine (175 g, 2 equivalent) is then added via an addition funnel over two and a half hours. 200 ppm of siloxane foam inhibitor is added. The reaction is maintained at 135° C. for four hours. The flask is then heated to 165° C. and held for five hours. The reaction is then cooled to 140° C. and vacuum stripped for two hours (10 Torr) to remove xylene. The product is then cooled to 120° C. and poured in a jar. The final product is a brown liquid. Yield=245 g.

Comparative Example 1 (CE1) is a commercially available axle fluid containing no additional friction modifier.

Comparative Example 2 (CE2) is a commercially available axle fluid containing 4 wt % of a commercially available phosphorus-containing friction modifier.

Axle Lubricant 1 (ALEX1) is a commercially available axle fluid to which is added 1.8 wt % of the product of EX1.

Axle Lubricant 2 (ALEX2) is a commercially available axle fluid to which is added 1.8 wt % of the product of EX2.

Axle Lubricant 3 (ALEX3) is a commercially available axle fluid to which is added 1.8 wt % of the product of EX3.

The lubricants (CE1 to CE2 and ALEX1, ALEX2, and ALEX3) are evaluated in a Full-Scale Low-Velocity Friction Apparatus (FSLVFA). The apparatus uses a clutch test specimen as defined by Haldex® HC 100.5. The test is run while varying the speed, temperature and pressure. The test consists of friction performance evaluations at the beginning and after a 17-hour durability stage. A break-in phase runs 10 minutes at 90° C. oil temperature, 16 rpm, and 7070 N load. The phase conditions the clutch system for the pre-durability performance evaluation. The pre-durability performance evaluation is achieved by ramping the speed from 0 to 5 rpm in 5 seconds, then back to zero. Load is set to two levels, 3535 N and 7070 N, which correspond to the range of axial compressive load imposed by the axle's internal clutch pack. The above two loads are evaluated at three oil temperatures: 40° C., 90° C., and 120° C. The sample clutch pack undergoes a durability phase that involves running the test rig for 17 hours at 120° C. oil temperature, 7070 N load, and 16 rpm. The post-durability evaluation is then run using the same conditions as the pre-test evaluation. A more detailed description of the test procedure is provides in SAE Paper 2001-01-3270. The table below shows a post durability rating of NVH(@5 rpm) and curvature of CE1, CE2, ALEX1, ALEX2, and ALEX3. The data obtained is as follows:

| Fluid | NVH (@ 5 rpm) | Curvature |
|---|---|---|
| CE1 | 8.28 | 30.98 |
| CE2 | 3.1 | 8.06 |
| ALEX1 | 1.58 | 3.37 |
| ALEX2 | 1.30 | 1.69 |
| ALEX3 | 1.67 | 5.29 |

Footnotes:

Noise, Vibration, Harshness (NVH) at 5 rpm is the standard deviation of the torque signal based upon a moving average of the torque during the 2 second hold at 5 rpm. The advantage of using a moving average to calculate the standard deviation is that a "bow" in the torque signal will not increase NVH. NVH describes the typical amplitude of the torque signal, not its shape. Good FM candidates should have lower NVH at 5 rpm.

Curvature describes shape of the torque signal which is believed to be related to the difference between the static and dynamic friction coefficients. Curvature is the average difference between the torque when the plates breakaway and come to rest versus the torque during the 2 second hold at 5 rpms. A positive curvature means the torque signal is concave up during the sweep (bows downward). A negative curvature means the torque signal is concave down (bows upward) during the sweep. Ideally curvature should be close to zero which would mean the torque signal is flat across all speeds. Slight negative curvature value is acceptable but high positive curvature value is less desirable.

The results indicate that post-durability data of CE1 shows a higher NVH value and more curvature than that of CE2. The post-durability data of ALEX1, ALEX 2, and ALEX 3 show much lower NVH and curvature. The amount of oscillation in the torque curve indicates a large amount of stick-slip event which would lead to a large amount to noise. The three fluids under consideration ALEX1, ALEX2, and ALEX 3 show minimal amounts of oscillation and hence less noise than CE1 and CE2.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704. When the term "hydrocarbyl" or "hydrocarbylene" is used herein without an indication as to the number of carbon atoms contained therein, it may be interpreted to encompass 1 to 36, or 1 to 24, or 1 to 20, or 1 to 18, or 1 to 12, or 1 to 8 carbon atoms.

Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

Each of the documents referred to above is incorporated herein by reference, including any prior applications, whether or not specifically listed above, from which priority is claimed. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and an oil-soluble compound obtained by a process of reacting an N-(2-hydroxyalk(en)yl)alkylenediamine-N,N',N'-tricarboxylic acid or an N-(alk(en)yl)-alkylenediamine-N,N',N'-tricarboxylic acid or an alkylenediamine-N,N,N',N'-tetracarboxylic acid with an amine or an alcohol, wherein the oil-soluble compound is in the form of a mixture comprising:

(a) at least 50 mole % to 99.9 mole % of a material represented by the formula:

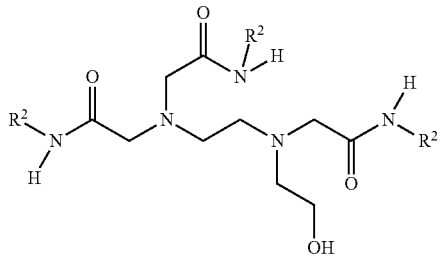

and (b) 0.1 mole % to less than 50 mole % of a material represented by the formula:

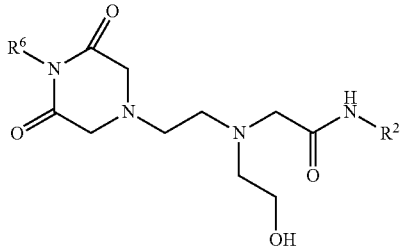

wherein $R^2$ is a hydrocarbyl group containing 1 to 150 carbon atoms, or an amino-substituted hydrocarbyl group, or an ether-substituted hydrocarbyl group, or a hydroxy-substituted hydrocarbyl group; and $R^6$ is a hydrocarbyl group having 1 to 100 carbon atoms; and wherein the oil-soluble compound is present in an amount in the range of 0.01 wt % to 5 wt % of the lubricating composition.

2. The lubricating composition of claim 1, wherein the oil-soluble compound is present in an amount in the range of 0.1 wt % to 3 wt %.

3. The lubricating composition of claim 1, further comprising a sulphur-containing compound.

4. The lubricating composition of claim 3, wherein the sulphur-containing compound is a dimercaptothiadiazole or derivative thereof, or mixtures thereof.

5. The lubricating composition of claim 3, wherein the sulphur-containing compound is a polysulphide or a sulphurised olefin.

6. The lubricating composition of claim 1, wherein the lubricating composition further comprises a phosphorus-containing compound.

7. The lubricating composition of claim 6, wherein the phosphorus containing compound is an amine salt of a phosphoric acid ester.

8. The lubricating composition of claim 7, wherein the amine salt of a phosphoric acid ester is an amine salt of either (i) a hydroxy-substituted di-ester of phosphoric acid, or (ii) a phosphorylated hydroxy-substituted di- or tri-ester of phosphoric acid.

9. The lubricating composition of claim 1, wherein the lubricating composition further comprises a boron-containing compound.

10. The lubricating composition of claim 9, wherein the boron-containing compound is a borated dispersant, a borate ester or a borated phospholipid.

11. The lubricating composition of claim 1, wherein the lubricating composition has a sulphur content in the range of 0.3 wt % to 5 wt %.

12. A method of lubricating a limited slip differential comprising supplying to the limited slip differential a lubricating composition of claim 1.

* * * * *